United States Patent [19]

Kapoor

[11] 4,290,359

[45] Sep. 22, 1981

[54] DAMPENING ASSEMBLY

[75] Inventor: Vinod Kapoor, Bayside, N.Y.

[73] Assignee: Butler Greenwich Inc., Greenwich, Conn.

[21] Appl. No.: 5,218

[22] Filed: Jan. 22, 1979

[51] Int. Cl.[3] ..... B41F 7/40; B41L 25/16

[52] U.S. Cl. ..... 101/148; 101/350; 101/352; 101/363; 101/247

[58] Field of Search ..... 101/148, 349, 350, 351, 101/352, 363, 364, 247, 218, 206, 207, 208, 209, 210, 136, 137, 138, 139, 140, 141, 142, 143, 144, 145

[56] References Cited

U.S. PATENT DOCUMENTS

| | | | |
|---|---|---|---|
| 1,911,048 | 5/1933 | Adsit et al. | 101/209 X |
| 2,387,750 | 10/1945 | Davidson | 101/144 X |
| 2,583,639 | 1/1952 | Faeber et al. | 101/352 |
| 2,735,365 | 2/1956 | Bromberg | 101/425 X |
| 2,830,555 | 4/1958 | Barrett | 101/363 X |
| 3,286,622 | 11/1966 | Mestre | 101/352 X |
| 3,425,345 | 2/1969 | Gates | 101/350 X |
| 3,789,757 | 2/1974 | Motter et al. | 101/153 |

*Primary Examiner*—J. Reed Fisher

*Attorney, Agent, or Firm*—Cesari and McKenna

[57] ABSTRACT

A dampening assembly for a printing press has its components including the water tray, fountain roller and ancillary parts mounted on a frame which is supported from the press frame by means of parallel arms. A piston or comparable device is used to swing the arms about their pivotal connections to the machine frame so as to swing the dampening assembly between an operative elevated position and a lower laterally displaced servicing position to provide access to the interior of the press for quick change-over of the printing plate and for maintenance. The supporting arms are shaped and dimensioned so as to remain parallel to one another as the assembly is moved between its two positions, thereby to maintain the assembly frame and particularly the water tray thereon substantially horizontal to avoid spillage of water.

5 Claims, 3 Drawing Figures

DAMPENING ASSEMBLY

BACKGROUND OF THE INVENTION

This invention relates to a roller dampening assembly for an offset printing press. It relates more particularly to an assembly of this type which can easily be moved away from its contacting plate cylinder to an accessible location to permit quick plate change-over for successive jobs and servicing of the plate cylinder and other ancillary press parts and to facilitate maintenance of the dampening assembly.

Offset presses require a dampening assembly to moisten the surface of the press plate cylinder. There are many different types of dampening systems used on offset printing presses. A typical dampening assembly includes a rotating water fountain roller which picks up water from a fountain pan and transfers it as a film to an adjacent contacting metering roller which, in turn, applies a water film of the desired thickness to an ink and water roller. That roller also receives ink from a contacting ink roller and transfers ink and water films to the print cylinder. The water adheres to the "no print" areas of the print cylinder while the ink which is hydrophobic adheres to the "print" areas thereof. The printed matter on the cylinder is thereupon transferred to a blanket cylinder which contacts the web to be printed. Of course, there are other types of dampeners using ductors which apply moisture to plate cylinder rather than to an ink and water roller.

In a vertical press, the paper moves vertically and printing cylinders and rollers are located on both sides of the web path. This configuration results in the dampener assembly blocking access to the plate cylinder. Thus, for plate change-over to run different jobs, the operator is required to go under the plate cylinder and dampener assembly. This makes the plate change-over time-consuming and inefficient.

In order to allow access for plate change-over, the dampening assembly has heretofore been mounted on rollers permitting it to be rolled out laterally from the press. Such roll-out dampening assemblies tend to be relatively expensive. Also space must be available to accommodate the rolled out assembly. Finally those prior assemblies have various components which are prone to wear. This not only increases maintenance down time but also creates tolerance problems which make it more difficult to properly position the dampening assembly at its operative location in the press.

SUMMARY OF THE INVENTION

Accordingly it is an object of the invention to provide a movable dampening assembly for a printing press which is relatively inexpensive to make and maintain.

A further object of the invention is to provide a dampening assembly of this type which permits ready access to the interior of the press for purposes of plate change-over, inspection and servicing of various rollers and cylinders therein.

Another object of the invention is to provide a movable press dampening assembly whose parts suffer minimum wear.

Still another object of the invention is to provide a dampening assembly for a printing press which can be moved to an accessible location without requiring an appreciable amount of extra space.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the subject dampening assembly is arranged to be mounted in a so-called vertical press. In this type of press, the rollers for inking the plate cylinder are situated near the top of the press. The plate cylinder receives an ink film from the lowest roller in the inking roller train. Simultaneously it receives a film of water from a contacting dampening roller supported on a dampening roller assembly situated adjacent to the plate cylinder. Thereupon, the plate cylinder transfers the ink at those locations corresponding to the printed matter on the plate to a blanket cylinder which contacts the web to be printed.

The dampening assembly includes a frame supporting a water pan and a rotatable fountain roller extending into the water fountain pan. A metering roller rotatively supported by the frame contacts the fountain roller and an ink and water roller also supported by the frame. During normal operation of the press, the last roller is maintained in rolling contact with the plate cylinder and with an ink-bearing roller. Provision is also made for maintaining a substantially constant level of water in the water pan.

To enable different jobs to be run on the press, the image carrier plate has to be changed. Therefore the operator requires clear access to the plate cylinder so as to be able to take off the old plate and mount a new plate on the plate cylinder in a minimum of time. Because of the placement of the dampening assembly and its supporting structure within a press of this type, the assembly tends to conceal and obstruct the plate cylinder. Accordingly provision is made for moving the dampening assembly to an accessible location away from the plate cylinder. However, instead of sliding or rolling the dampening assembly laterally out of the press as was done heretofore, the present assembly is mounted on an exceptionally sturdy swingable support. The assembly can be swung from its normal raised operative position adjacent the plate cylinder to a lower position near the base of the press thereby permitting the operator to have a clear access into the press so that he can readily mount or dismount the plate onto the cylinder and inspect other parts.

The dampening assembly is raised and lowered between its two positions by four similar, generally triangular frame members. The frame members have relatively long legs which are parallel to one another and whose ends are pivotally connected to the four corners of the dampening assembly frame. The frame members also have relatively short legs pivotally connected at their ends to hydraulic actuators secured at the bottom of the machine frame. Of course, any other suitable means of actuation such as a pneumatic cylinder or electric motor and a lead screw may be used. The corner of each frame member between the two legs of the triangle are pivotally connected to the machine frame above the actuators. The arrangement of links and pivot points is so arranged as to result in a parallelogram configuration. The links supporting the dampener assembly are equal in length and the distance between pivot points on the press frame is equal to the distance between pivot points on the dampener support frame.

Thus the short legs of the frame members function as lever arms so that with a relatively small amount of throw of the actuators against the short legs of the frame members, the ends of the long frame member legs connected to the assembly can be swung over relatively large distances. Consequently, the assembly can be moved between its elevated position adjacent the print cylinder located near the upper end of the press and an accessible lower position relatively close to the floor. Moreover the corresponding legs of the frame members remain parallel to one another as the assembly swings between its two positions. Consequently the assembly and particularly the water pan remain in a horizontal plane thereby avoiding any spillage of water from the tray.

Provision is also made for positively locking the assembly in its operative raised position so that it is assuredly in the proper relationship with the plate cylinder. Also a cut off switch is provided for deenergizing the motive means for the rollers in the assembly when the assembly is not in its raised operative position to prevent damage to the equipment and injury to the operator.

The aforesaid dampener assembly can be removed away from plate cylinder, providing access to the plate cylinder for mounting and taking off the printing plates. This makes for fast change-over and efficient operation.

Thus the assembly provides definite advantages in terms of access to the interior parts of the press as compared with the conventional fixed or roll out type dampening assemblies. Furthermore it utilizes no sliding parts and fixtures that may, through wear, upset the positional relationship of the assembly relative to the print cylinder or other parts of the press. Yet with all of these advantages, the assembly is less expensive to make and install than the prior comparable apparatus of this general type.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1:
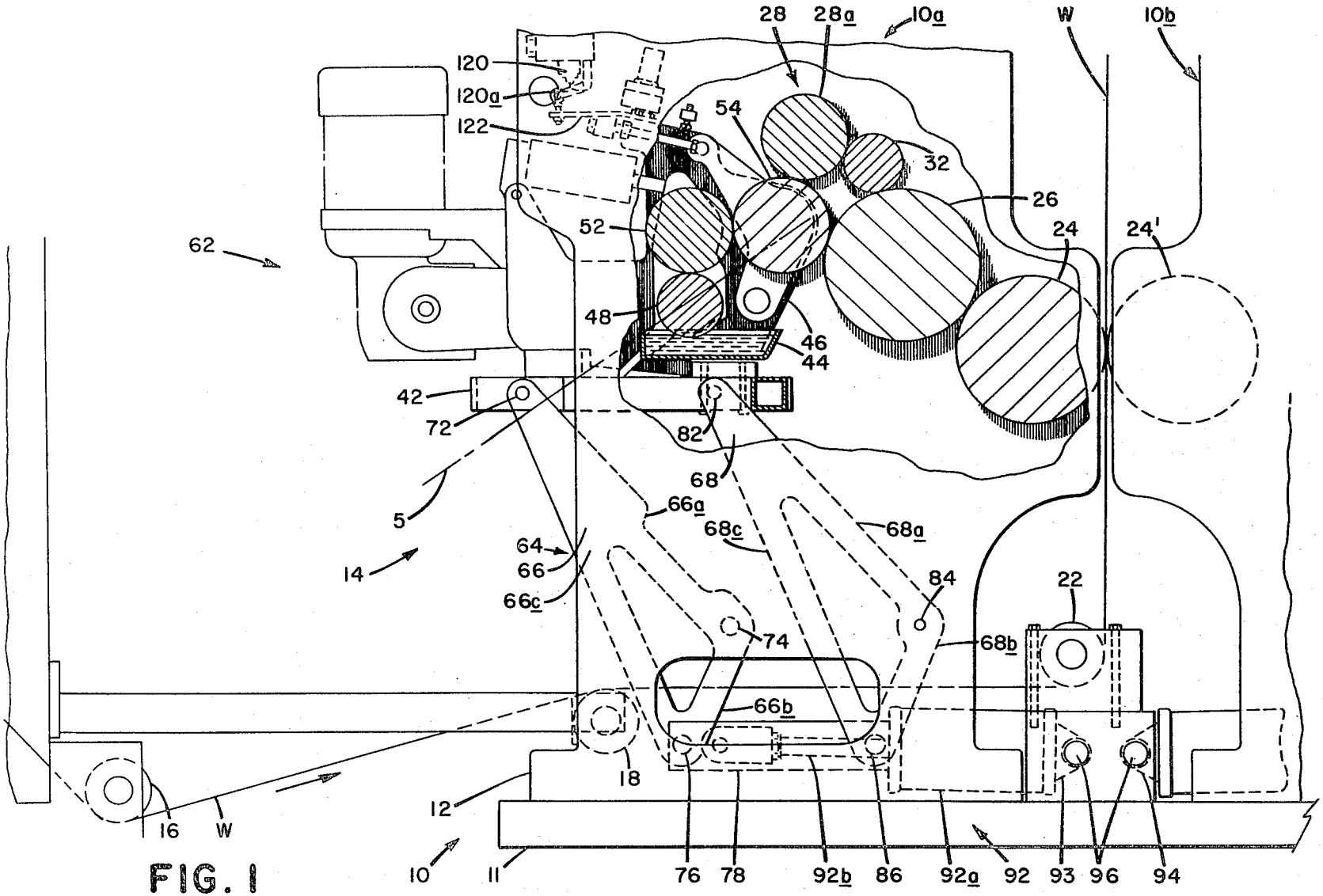
FIG. 1 is a fragmentary side elevational view of a vertical press incorporating a dampening assembly made in accordance with this invention, showing the assembly in its operative raised position.

Referring to the drawing figures, a vertical printing press indicated generally at 10 is arranged to print on a web W traveling through the press. The illustrated press is arranged to print on both sides of the web at the same time. Consequently it comprises a pair of side-by-side press sections 10*a* and 10*b* which are more or less mirror images of one another which rest on a flat bed 11. Accordingly, we will confine our detailed description to the press section 10*a*.

The press section has the usual relatively massive upstanding front and rear frame plates 12 with the various press parts being mounted between these plates. The press dampening assembly of this invention is indicated generally at 14.

Web entering the press 10 passes under a guide roller 16 and over a guide roller 18 located directly below assembly 14. From roller 18, the web is conducted horizontally and engaged under a turning roller 22 which redirects the web W vertically upwards between blanket rollers 24 and 24' which actually apply the printed image to both sides of the web W. Thence the web is conducted out of the press.

The press section 10*a* also includes the usual plate cylinder 26 rotatively supported between the press side plates 12. Ink is applied to the plate cylinder by means of the ink roller train shown generally at 28, the lowermost roller 28*a* of which rotatively contacts a metering roller 32 which, in turn, contacts plate cylinder 26.

The dampening assembly 14 comprises a generally rectangular frame 42 on which are mounted the various components of the assembly 14. These components include a water tray 44 supported on frame 42 near the right hand side thereof closest to cylinder 26. Projecting up from frame 42 at the front and rear ends thereof are a pair of frame plates 46, only one being shown in the drawing figures. Rotatively supported between plates 46 is a water fountain roller 48 whose surface extends down into the water tray 44. Also rotatively supported between plates 46 just above roller 48 and in contact therewith is a water metering roller 52 which contacts an ink and water roller 54 also rotatively supported between plates 46. When assembly 14 is in its raised operative position illustrated in FIG. 1, roller 54 contacts the print cylinder 26, the ink roller 28*a* and the water metering roller 52.

Also supported on frame 42 is the usual apparatus for delivering water to tray 44 and maintaining it at a selected level so that a sector of the water fountain roller 48 is always immersed in the water in the tray. Also provision is made for rotating the rollers in assembly 14, indicated generally at 62, so that water from the tray is metered onto roller 54 and thereupon applied as a film to the print cylinder 26.

Figure 3:
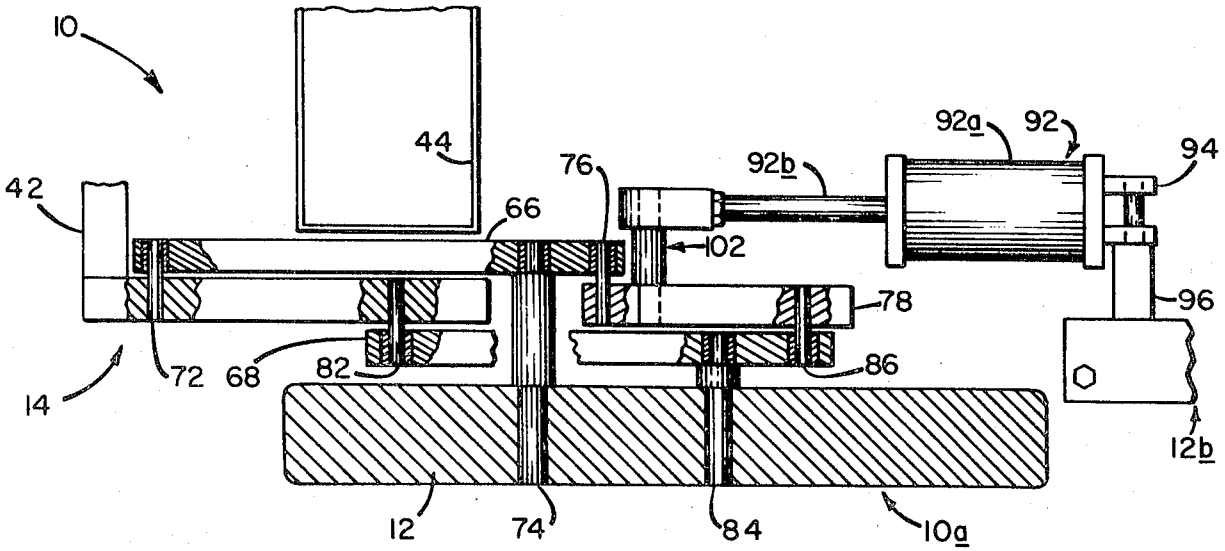
FIG. 3 is a sectional view along line 3—3 of FIG. 2 showing only one half of the press, the other half being essentially a mirror image of the half shown.

The frame 42 and the various parts thereon are supported from the machine frame plates 12 by a support assembly shown generally at 64. Assembly 64 includes four generally triangular frame members. More particularly, a pair of frame members 66 and 68 support the front of the assembly frame 42. An identical pair of frame members 66 and 68 support the rear of that frame. Each frame member 66 includes a relatively long leg 66*a* one end of which is connected by a pivot pin 72 to frame 42 near one corner thereof. The other end of that same leg is connected by a pivot pin 74 to press frame 12 (FIG. 3). The end of the short leg 66*b* of each frame member 66 is connected by a pivot pin 76 to one end of link 78 at the inboard face of the link.

Each frame member 68 has the end of its long leg 68*a* connected by a pivot pin 82 to frame 42 at the opposite side thereof from pivot pin 72. The opposite end of the frame leg 68*a* is connected by pivot pin 84 to press frame 12 at the same height thereon as the corresponding pivot pin 74. The opposite end of the leg 68*b* is pivotally connected by a pivot pin 86 to the opposite end of link 78 at the outboard side thereof. As best seen in FIG. 1, the distances between the pivot pins 72 and 74 on the one hand and pins 82 and 84 on the other are exactly the same. Likewise the distances between pins 74 and 76 on the one hand and pins 84 and 86 on the other are the same. Furthermore the distance between the pivot pins 72 and 82 connected to the assembly frame 42 is exactly the same as the distance between the pin 76 and 86 secured to the link 78, and is also equal to the distance between pivot pins 74 and 84.

Thus the long legs of the two pairs of frame members 66 and 68 form parallel arms which pivotally support the front and rear of the assembly frame 42 above the pivot pins 74 and 84 secured to the machine frame. On the other hand, the short legs **66*b* and 68*b* of the frame members constitute parallel lever arms which are used to swing the frame member legs 66*a* and 68*a* about their pivots to the frame. The hypotenuses 66*c* and 68*c* of the frame members 66 and 68** function as reinforcing struts to rigidify and strengthen the support assembly.

Figure 2:
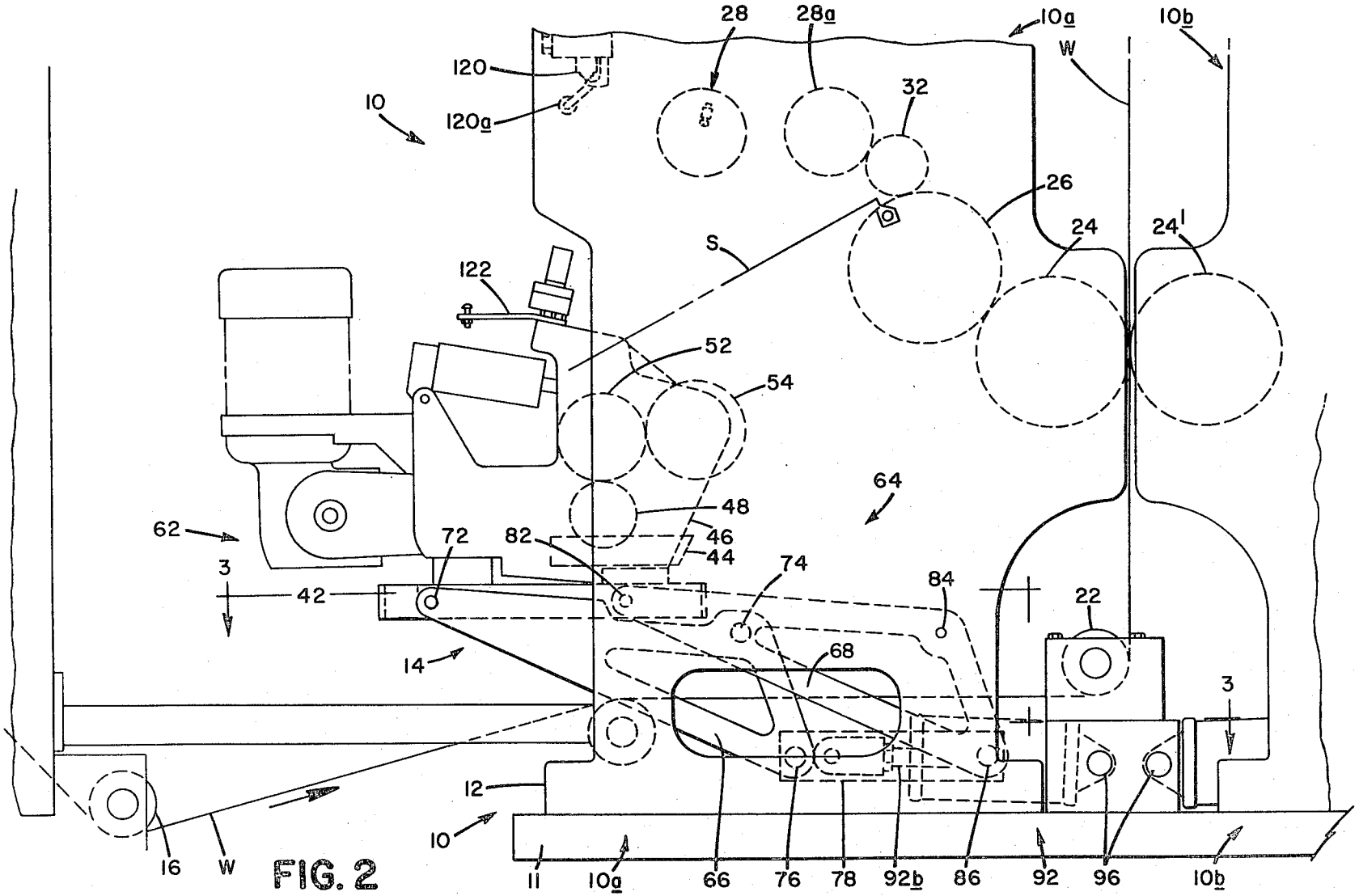
FIG. 2 is a view similar to FIG. 1 illustrating the assembly in its lower position for servicing the press.

Thus by moving the links 78 horizontally, the frame members 66 and 68 can be swung between a first position illustrated in FIG. 1 wherein they support the assembly frame 42 so as to maintain the fountain roller 54 in rolling contact with the ink roller **28*a* and the print cylinder 26 to a lower position shown in FIG. 2 wherein the frame 42 and the parts thereon are located in an open space to the left of the press plates 12 close to the floor. As best seen in FIG. 2, when the assembly 14 is in its lower position, the operator has a clear access along sight line S to the plate cylinder 26 as well as the ink rollers 28*a* and 32. The printing plate(s) can thus be conveniently mounted to the plate cylinder as shown. Furthermore, the components of assembly 14 such as the water tray 44** and the fountain rollers are readily accessible should they need cleaning or maintenance.

Assembly 14 is moved between its two positions by a pair of double acting hydraulic pistons 92 positioned more or less horizontally at the front and rear of the press. Each piston 92 has a cylinder **92*a* formed with ears 93 projecting from one end. These ears have openings 94 for rotatively receiving a pivot pin 96 connected to a frame block 12*b* (FIG. 3) extending inward from plate 12 at a location directly below the guide roller 22 and well below the pivot pins 74 and 84 to the frame members. Each piston also has a piston rod 92*b* extending generally parallel to link 78 at the inboard side thereof. The end of the rod is pivotally connected to one end of a pivot pin 102, the opposite end of which is rotatively secured to the adjacent link 78 at a location next to pivot pin 76 therein. The pivot pin 102 is long enough to provide clearance for the frame member 66 situated between the link and the piston rod as shown in FIG. 3**.

The pistons 92 can be actuated by any convenient means so as to extend the piston rods thereby moving links 78 to the left as viewed in FIG. 1 thereby to pivot the frame members 66 and 68 about their pivot pins 74 and 84 to swing the dampening assembly 14 to its raised position illustrated in FIG. 1. Likewise the pistons can be actuated conventionally to retract the piston rods so as to urge links 78 toward the right thereby to swing assembly to its lower position shown in FIG. 2. Because of the shape of the frame members 66 and 68, a relatively small movements of the links 76 connected to the short legs of the frame members suffices to swing the opposite ends of those members through a relatively large distance in order to move the dampening assembly between its two positions. Consequently, the pistons 92 can be relatively small and compact. Further, as noted previously, since the legs of the frame members 66 and 68 remain parallel to one another throughout their movements, assembly frame 42 and the water tray 44 thereon remain horizontal as the assembly is swung between the two positions. Consequently, there is no spillage of water from the tray.

If desired, means may be provided for positively locking assembly 14 in its raised operative position.

Also as a safety precaution, a cut-off switch 120 having an actuating arm **120*a* is connected in circuit with the motive means driving the rollers of assembly 14. This switch is supported by a press plate 12 directly above the assembly 14. When the assembly is in its raised position, a finger 122 connected to the top of an assembly frame plate 46 engages the switch arm thereby closing the switch and permitting the assembly to operate properly. On the other hand, when assembly 14 is swung away from its normal raised position, the finger 122 is moved away from the switch arm 120*a*** thereby causing the switch to open and deenergize the motive means.

It is important to note that the various members supporting assembly 14 are all pivoting members rather than sliding members. Consequently, those rotary parts are much less prone to wear and they are easily lubricated using standard grease fittings. Consequently, even after the assembly has been raised and lowered numerous times, there is no appreciable parts wear as might prevent the assembly from properly positioning the fountain roller 54 against the plate cylinder and ink roller. Yet with all of these advantages, the subject dampening assembly 14 is less expensive to make and install than the roll out type assemblies used heretofore.

It will thus be seen that the objects set forth above among those made apparent from the preceding description are efficiently attained and certain changes may be made in the above construction without departing from the scope of the invention. For example, the motive means for movement of the dampener assembly may be a pneumatic cylinder, or an electric motor lead screw combination. Thus, it is intended that all matter contained in the above description or shown in the accompanying drawings shall be interpreted as illustrative and not in a limiting sense.

It will also be understood that the following claims are intended to cover all of the generic and specific features of the invention herein described.

I claim:

1. A dampening assembly for a printing press of the type including a supporting machine frame, a plate cylinder rotatively mounted at an elevated location on the machine frame and a set of inking rollers for applying ink to the plate cylinder, said assembly comprising (A) an assembly frame, (B) a water tray supported horizontally on the assembly frame, (C) a water fountain roller rotatively supported on the assembly frame so that a surface portion of said roller extends into the tray, (D) at least one additional roller rotatively mounted to the assembly frame for conducting water from the fountain roller to the plate cylinder, (E) motive means for rotating the rollers, and (F) means for swingably supporting the assembly frame from the machine frame so that the assembly frame and the parts supported thereby can be swung between an elevated position wherein said at least one additional roller supported on the assembly frame contacts the plate cylinder to a lower position adjacent the floor wherein the assembly frame and the parts supported thereby are displaced laterally relative to the plate cylinder so as to provide a clear access path to the plate cylinder in order to change plates quickly during a printing run, said supporting means maintaining said assembly frame and the tray supported thereby in a horizontal position as the assembly is moved between its said two positions, said supporting means including (1) a plurality of similar generally triangular frame members, each member having (i) a long leg pivotally connected at its opposite ends to the assembly frame and the machine frame respectively, the long legs of all of said frame members being parallel to one another, all of said members having the same distance between their said pivotal connections, and (ii) a relatively short leg, and (2) means for applying a force to each short frame member leg so as to cause said frame members to pivot about their pivotal connections to said machine frame.

2. The assembly defined in claim 1 wherein the supporting means comprises (A) a plurality of parallel arms of equal length, means for pivotally connecting one end of each arm at a different location on the assembly frame, (B) means for pivotally connecting the opposite end of each arm to different locations on the machine frame, and (C) means acting between the machine frame and at least one of said arms so as to cause said arms to pivot about their pivotal connections to the machine frame so as to move the assembly frame between its said two positions.

3. The assembly defined in claim 2 wherein said acting means comprises a hydraulic piston.

4. The assembly defined in claim 1 and further including (A) a switch mounted to one of said machine frame and assembly frame, said switch being electrically connected to the motive means, and (B) means on the dampening assembly for tripping the switch when the assembly is moved away from its said raised position thereby to open said switch.

5. The assembly defined in claim 1 wherein said force applying means comprises at least one piston connected between said machine frame and said short frame member legs so that a relatively small extension of the piston produces a substantially larger motion of said opposite frame member ends connected to the assembly frame.

* * * * *